United States Patent [19]

Kovins

[11] 4,215,778

[45] Aug. 5, 1980

[54] INFLATABLE INSTRUMENT CASE

[76] Inventor: Michael Kovins, 109 Stonhurst La., Dix Hills, N.Y. 11746

[21] Appl. No.: 42,772

[22] Filed: May 29, 1979

[51] Int. Cl.[2] ..... A45C 11/00; B65D 81/02; B65D 85/30; B65D 85/54

[52] U.S. Cl. ..... 206/314; 206/14; 206/522

[58] Field of Search ..... 206/314, 14, 522

[56] References Cited

U.S. PATENT DOCUMENTS

| | | | |
|---|---|---|---|
| 1,675,957 | 7/1928 | Reeves | 206/522 |
| 2,449,591 | 9/1948 | Couse | 206/522 |
| 3,326,359 | 6/1967 | Katz | 206/14 |
| 3,346,101 | 10/1967 | Pestka | 206/522 |
| 3,398,501 | 8/1968 | Aninger | 206/522 |

*Primary Examiner*—William T. Dixson, Jr.
*Attorney, Agent, or Firm*—Robert D. Farkas

[57] ABSTRACT

An inflatable instrument case for musical instruments includes upper and lower complementary sections, each including an inner wall and an outer wall member, forming a cavity therein between. Such cavity is inflatable. Each inner wall, of each complementary section, includes a portion thereof having an inflatable section which is independently inflatable from the cavity in each complementary section. Thus, an interior cavity is provided, surrounded by an inflatable structure, such that the inflatable structure is encapsulated within the cavities formed within the complementary sections. The exterior surface of each complementary section may be covered with a flexible material, simulating a leather-like appearance. A musical instrument may be carried within the structure, totally protected as if by floating within a column of air, and surrounded by the interior inflatable covering thereover. A flexible locking means is provided for releasably securing the complementary sections together, having one marginal edge of each section pivotably secured to each other, in hinge-like fashion.

9 Claims, 5 Drawing Figures

INFLATABLE INSTRUMENT CASE

BACKGROUND OF THE INVENTION

THE FIELD OF THE INVENTION

The present invention relates to protective cases for musical instruments or the like and more particularly, to a inflatable instrument case for musical instruments.

DESCRIPTION OF THE PRIOR ART

The need to protect musical instruments or the like from damage during transportation and storage has been long standing. Characteristically, musical instruments are delicate and subject to damage which not only effects the visual aesthetic qualities of the instrument, but only impedes the music producing abilities thereof. In a quest to produce an instrument case with suitable protective qualities, manufacturers and designers have produced rigid bulky cases. This can offer adequate protection, but in themselves, create a storage problem when the instruments are in use as these rigid cases are rather bulky to store. Also where weight during transportation is a primary concern, as during air travel, the bulken weight of these rigid cases is a serious disadvantage. The present invention overcomes the problems associated with the prior art by producing an inflatable instrument case for musical instruments or the like, which offers excellent protection for the instruments stored therein, and which may be deflated and folded for compact storage when the instrument is in use. Further, the present invention provides a double wall arrangement, each having trapped air therein, thereby providing double efficiency against accidental piercing of the case, causing the musical instrument to be damaged when the case, carrying the musical instrument therein, is thrown about. Finally, because of the discrete arrangement of the double air bound compartments, that is, one within the other, the musical instrument contained within the inner compartment is substantially disposed riding within a cushion of air and is suitably protected against virtually any kind of shock or impact, exerted upon the exterior surface of the outer inflated compartment.

U.S. Pat. No. 3,587,794, issued June 28, 1971 to H. Mattell teaches a generally rectangular suitcase having a flexible top, side and end walls and a rigid bottom wall. The top and end walls are lined with tubular air-inflatable pockets. When the pockets are inflated, the suitcase is self-supporting and stands upright. When the pockets are deflated, the suitcase collapses on the bottom wall to form a flat, compact package. A slide fastener closure is provided at one side wall. The side walls may be lined with thermal insulative material. Thus, the Mattell apparatus teaches a wall-like structure, which may be inflated and deflated at the will of the user, wherein such wall-like structure is disposed in a container-like shape into which an article may be carried. However, in terms of protecting the article, only two layers of fabric-like material, air impervious in nature, and a body of air, separates the exterior surface of the article and the exterior of the carrying case therefor.

U.S. Pat. No. 3,366,231, issued Jan. 30, 1968, to E. P. Trakas discloses an inflatable packaging equipment, wherein each of two elements, comprising a multi-cavity structure, are inflatable in nature, on an independent basis and have compartments disposed therein between. Articles, of any variety, may be carried within such compartments, located on the exterior surface of the exterior opposite surfaces of such two structures. Another pair of structures, disposed juxtaposed over the first pair of structures, so as to have adjacent compartments located surrounding each article to be carried in such compartments, permits the articles to be protected by the inflatable structure, comprising the compartment. However, spacers, or other rigid elements, are utilized to space apart the pair of structures defining the pallet-like pair of elements, thereby precluding the ability to insure that the article to be stored, is in a "floating" relationship, within each pair of elements.

SUMMARY OF THE INVENTION

A primary object of the present invention is to provide an inflatable instrument case for musical instruments, or the like, which offers the instruments stored therein excellent protection.

Another object of the present invention is to provide an inflatable instrument case which may be collapsed and stored completely when the musical instrument is in use.

Still another object of the present invention is to provide an instrument case which is extremely lightweight.

Yet another object of the present invention is to provide an inflatable instrument case which is ideally suited for constructing in different sizes and shapes to accommodate various musical instruments.

A further object of the present invention is to provide an inflatable instrument case for musical instruments, or the like, which is simple in design, inexpensive to manufacture, and durable in use.

These objects, as well as further objects and advantages, of the present invention will become readily apparent after reading the description of a non-limiting illustrative embodiment and the accompanying drawing.

According to the principles of the present invention, there is provided an inflatable instrument case for musical instruments, or the like, which include upper and lower complementary sections, each including a plurality of inflatable elements, each of the plurality of inflatable elements having a pair of opposed sides and uppermost and lowermost surfaces, each of the plurality of inflatable elements fixedly secured on at least one of the opposed sides thereof to one of the opposed sides of an adjacent inflatable element, the opposed ends of each of the inflatable elements being proximate to the opposed ends of an adjacent inflatable element when the opposed sides thereof are secured together, the uppermost surfaces of each of the plurality of the inflatable elements providing a recessed area, the recessed areas forming an open ended chamber in the upper section and an open ended chamber in the lower section, the recessed areas being defined by walls that are inflatable, such inflatable walls being independently inflatable from the inflatable elements, the upper and lower complementary sections dimensioned to be selectively disposed in an overlaying relationship with the uppermost surfaces thereof disposed in a touching relationship, the open-ended chambers forming an enclosed storage chamber; means for communicating air to each of the plurality of inflatable elements of both the upper and lower complementary sections; means for communicating air to each of the wall members; and means for selectively joining the upper and lower complementary sections together.

These objects as well as other objects of the present invention, will become more readily apparent after reading the following description of the accompanying drawings.

BRIEF DESCRIPTION OF THE DRAWINGS

In order that the present invention may be more fully understood, it will now be described, by way of example, with reference the accompanying drawings in which.

DESCRIPTION OF THE PREFERRED EMBODIMENT

Figure 1:
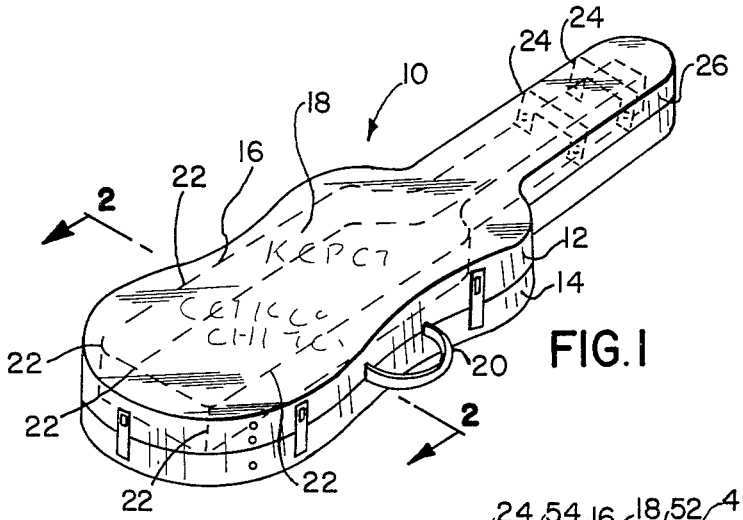
FIG. 1 illustrates the present invention, in perspective form.

Now referring to the figures, and more particularly to the embodiment illustrated in FIG. 1 there is illustrated therein an inflatable instrument case 10, having an upper and lower complementary section 12 and 14 respectively. Uppermost surface 16, of upper complementary section 12, has indicia 18 thereon. Handle 20 is affixed to upper complementary section 12, but may, if desired, be similarly affixed to lower complementary section 14. Dotted lines 22 depicted a recessed area, in upper complementary section 12. Not shown, is another recessed area, in lower complementary section 14, disposed in abutting relationship with the upper recessed area. Dotted lines 24 depict gussets extending about the recessed area defined by dotted lines 22 such that gussets 24 communicate to side walls 26 of upper complementary section 12 and surface 16. The gussets, depicted by dotted lines 24, may be utilized along the entire length of apparatus 10, if desired.

Figure 2:
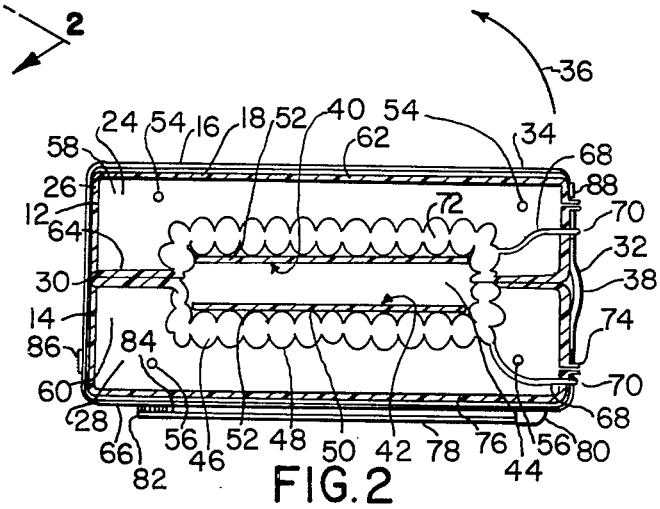
FIG. 2 is a side elevation, cross sectional view, taken across lines 2—2, when viewed in the direction of arrows 2—2, of the apparatus shown in FIG. 1.

FIG. 2 illustrates a side elevation, cross sectional view of a portion of the apparatus shown in FIG. 1, such that gusset 24 is located directly disposed over gusset 28, located in lower complementary section 14. Lower complementary section 14 is pivotably secured to upper complementary section 12 at point 30. As shown, uppermost surface 16 constitutes the outermost face of web 18, shown encircling all of the exterior surface of upper complementary section 12 and all of the exterior surface of lower complementary section 14. At point 32, upper and lowermost complementary sections 12 and 14 are separable if desired, such that upper complementary section 12 may have point 34 thereof pivot upward and outwardly, in the direction of arrow 36, when locking-like fastener 38 permits upper complementary section 12 to be opened relative to lower complementary section 14. Recessed area 40 and recessed area 42 shown located within upper and lower complementary sections 12 and 14 respectively, form a storage compartment 44 therein between. Such storage compartment is substantially surrounded by an inflatable barrier 46 achieved by the inflation of the elements 48 and 50. A soft foam-like web, comprising layers 52, located in the upper regions of recessed 40 and in the lower regions of recessed 42 provide a cushioned storage area on opposed major lateral surfaces thereof. Holes, or openings, 54, located in gusset 24, and holes 56, located in gusset 28, permit air, entrapped within spaces 58 and 60, to communicate to adjacent spaces. Gussets 24 and 28 limit sheet 18, and flexible film-like material 62, being air impervious, from bulging upwardly when space 58 is inflated. Portion 64, of film-like material 62, communicates to side walls 26, of upper complementary section 12. In like fashion, gusset 28 prevents lowermost surface 66 from bulging downwardly when compartment 60 is inflated. As can be seen, tubes 68 communicate to valves 70, at one end thereof and into the interior 72 and 46, of the inflatable portion of recesses 40 and 42. Valves 74 communicate into the interior of spaces 58 and 60, independently of tubes 68, thereby permitting spaces 58 and 60 to be inflated independently of spaces 46 and 72. Spaces 72 and 46 substantially float on webs 18 and 76 where such webs define the mating surfaces of upper and lower complementary sections 12 and 14 respectively. As can be seen, recesses 40 and 42 comprise a unitary recess, completely surrounded by an inflated structure, such inflated structure is in turn surrounded by another inflated structure such that either structure, when inflated independently, provides a measure of protection to the common recess cargo carrying area, destined to carry musical instruments therein. In the event that surface 16, preferably fabricated from a leather-like material, though flexible in nature, and sheet 18, preferably fabricated from polyvinyl chloride of the air impervious variety, becomes punctured, then webs 48 and 50, also preferably fabricated from air impervious polyvinyl chloride, protects the musical instrument, not shown, residing, resting and covered by foam-like sheet materials 52. When it is desired to store the musical instrument in a space far less than normal, the compartments or spaces 58 and 60 may be collapsed, thereby allowing the outermost covering, comprising surfaces 16 and 66 to rest upon the outermost surfaces of layer 48. Alternatively, if it is desired to insert a larger instrument, within recesses 40 and 42, the inner inflatable structure, constituting layers 48 and 50, need not be inflated. Strap 78 is shown having end 80 thereof secured to outermost surface 66. Such strap is flexible in nature and carries a fabric-like end 82 at end 84 thereof. A "VELCRO" fastener, of the type well known in the art, in the form of pad 86 and 88 is shown secured to the exterior of the lower and upper complementary section. When desired, and when recesses 40 and 42 are devoid of a cargo, and spaces 58 and 60, as well as cavities 72 and 46 are devoid of air, thereby being in a collapsed state, end 88 may be wrapped around the exterior of complementary sections 12 and 14, in a direction substantially counter to arrow 86, permitting the apparatus to be rolled up in a neat and compact bundle.

Figure 3:
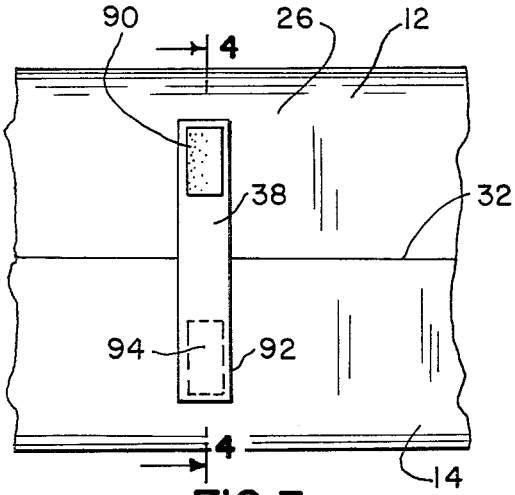
FIG. 3 is a side elevation view of a portion of the apparatus shown in FIG. 1.

FIG. 3 illustrates upper section 12 residing over lower section 14 having strap 38 shown such that end 90 thereof is secured to exterior surface 92 of lower complementary section 14. End 92, of strap 38, is provided with a "VELCRO" fastener 94 adapted to engage removeably a portion of a fabric-like material, not shown, residing juxtaposed with the "VELCRO", being secured to surface 26. Thus, when strap 38 is engaged, having the "VELCRO" fastener engaged to the fabric material, upper section 12 is engaged with section 14.

Figure 4:
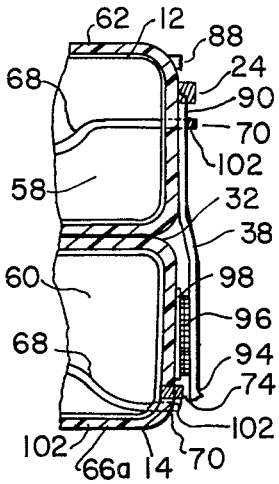
FIG. 4 is a side elevation, cross sectional view, of a portion of the apparatus shown in FIG. 3, taken along lines 4—4, when viewed in the direction of arrows 4—4.

FIG. 4 illustrates a portion of the apparatus shown in FIG. 1, in cross sectional view including upper complementary section 12 being shown in closed condition, abutting lower complementary section 14. Strap 38 is shown having "VELCRO" fastener 96 engaging a fabric-like web 98. Fabric-like web 98 is secured to the exterior surface 66a of lower section 14. It should be noted that air impervious web 62 and air impervious web 100, comprising upper and lower sections 12 and 14 respectively, are not shown having an outermost flexible covering. Tubes 68, terminate in valve portions 70, having an exterior threaded portion 102. Likewise, valves 74, communicating to cavities 58 and 60, are also provided with threaded sections.

Figure 5:
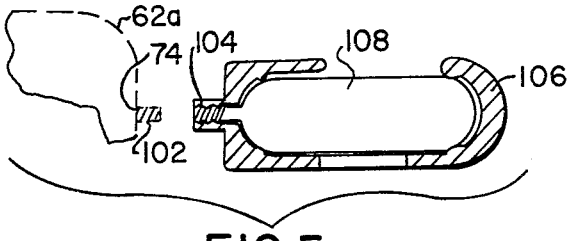
FIG. 5 is a side elevation, cross sectional view, of an apparatus useful in conjunction with the apparatus shown in FIG. 1.

FIG. 5 illustrates a portion of upper complementary section 12, shown in FIG. 4 by way of dotted lines 62a. Threaded portion 102, comprising the end of valve portion 74, is adapted to engage female threads of gas cartridge holder 106. A gas cartridge 108, is shown enclosed within holder 106, having its discharge end located adjacent threads 104. When holder 106 is turned, threads 104 and 102 engage, such that a needle-like projection, not shown, pierces the discharge end of cartridge 108, permitting the compressed gas stored within cartridge 108 to enter the confines of section 12 in a manner well known in the art. When holder 106 is threadingly disengaged from valve portion 74, then, valve portion 74 closes off in a manner well known in the art. The same process may be utilized for valve 70 for upper complementary section 12 as well as valves 70 and 74, for lower complementary section 14, as shown in FIG. 2.

One of the advantages of the present invention is an inflatable instrument case for musical instruments, or the like, which offers the instruments stored therein excellent protection.

Another advantage of the present invention is an inflatable instrument case which may be collapsed and stored completely when the musical instrument is in use.

Still another advantage of the present invention is an instrument case which is extremely lightweight.

Yet another advantage of the present invention is an inflatable instrument case which is ideally suited for constructing in different sizes and shaped to accommodate various musical instruments.

A further advantage of the present invention is an inflatable instrument case for musical instruments, or the like, which is simple in design, inexpensive to manufacture, and durable in use.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. An inflatable instrument case for musical instruments or the like comprising upper and lower complementary sections each including a plurality of inflatable elements, each of said plurality of inflatable elements having a pair of opposed sides and uppermost and lowermost surface, each of said plurality of inflatable elements fixedly secured on at least one of said opposed sides of an adjacent inflatable element, said opposed ends of each of said inflatable elements being proximate to the second ends of an adjacent inflatable element when said opposed sides thereof are secured together, said uppermost surfaces of each of said plurality of said inflatable elements providing a recessed area, said recessed areas forming an open-ended chamber in said upper section and an open-ended chamber in said lower section, said recessed areas bounded by a pair of flexible webs defining said recessed areas, said upper and lower complementary sections dimensioned to be selectively disposed in an overlaying relationship with the uppermost surfaces thereof disposed in a touching relationship, said open-ended chambers forming an enclosed storage chamber, means for communicating air to each of said plurality of inflatable elements of both said upper and said lower complementary sections, means for communicating air to said pair of flexible webs whereby said pair of flexible webs may be inflated and whereby said pair of flexible webs is contained totally within the interior of said upper and said lower complementary sections, and means for selectively joining said upper and said lower complementary sections together.

2. An inflatable instrument case as claimed in claim 1, wherein said communicating means comprises a plurality of air valves operably connected to selected said inflatable elements and a plurality of apertures located in selected said side walls for communicating air between selected adjacent said inflatable elements.

3. An inflatable instrument case as claimed in claim 1, wherein said selective joining means comprises hinge means and latch means.

4. An inflatable instrument case as claimed in claim 3, wherein said hinge means comprises a plurality of substantially flat flexible hinge elements each having a first end and a second end, said first ends fixedly secured to an edge of said upper section and said second ends fixedly secured to an adjacent edge of said lower section.

5. An inflatable instrument case as claimed in claim 3, wherein said latch means comprises a plurality of flexible strips each fixedly secured on the first end thereof to said upper section, a plurality of hooked type "VELCRO" pads fixedly secured to the second ends of each of said semi-flexible strips, a plurality of looped type "VELCRO" pads being fixedly secured to said lower section, each of said plurality of looped "VELCRO" pads for engaging one of each of said plurality of hooked "VELCRO" pads and thereby securing said upper and lower sections in said overlaying relationship.

6. An inflatable instrument case as claimed in claim 1, further comprising a handle fixedly secured to said lower section.

7. An air inflatable case as claimed in claim 1, wherein the interior of said pair of flexible webs is pneumatically decoupled to the interior of said upper and lower complementary sections.

8. The apparatus as claimed in claim 1, further comprising a leather-like material, said leather-like material being disposed fixedly secured to the exterior surface of at least one of said upper and lower complementary sections.

9. The apparatus as claimed in claim 8 further comprising indicia, said indicia being disposed on the exterior surface of said leather-like material.

* * * * *